US010316652B2

(12) United States Patent
Lee et al.

(10) Patent No.: US 10,316,652 B2
(45) Date of Patent: Jun. 11, 2019

(54) DOWNHOLE TELEMETRY TOOL WITH ADAPTIVE FREQUENCY TRANSMITTER

(71) Applicant: Evolution Engineering Inc., Calgary, Alberta (CA)

(72) Inventors: Gavin Gaw-Wae Lee, Calgary (CA); Justin C. Logan, Calgary (CA); Kurtis West, Calgary (CA); Luke Stack, Calgary (CA); Aaron W. Logan, Calgary (CA)

(73) Assignee: Evolution Engineering Inc., Calgary, Alberta (CA)

( * ) Notice: Subject to any disclaimer, the term of this patent is extended or adjusted under 35 U.S.C. 154(b) by 0 days.

(21) Appl. No.: 15/532,250

(22) PCT Filed: Dec. 11, 2015

(86) PCT No.: PCT/CA2015/051313
§ 371 (c)(1),
(2) Date: Jun. 1, 2017

(87) PCT Pub. No.: WO2016/095027
PCT Pub. Date: Jun. 23, 2016

(65) Prior Publication Data

US 2017/0268331 A1 Sep. 21, 2017

Related U.S. Application Data

(60) Provisional application No. 62/093,883, filed on Dec. 18, 2014.

(51) Int. Cl.
*E21B 47/12* (2012.01)
*E21B 47/18* (2012.01)

(52) U.S. Cl.
CPC ..... *E21B 47/187* (2013.01); *E21B 47/182* (2013.01)

(58) Field of Classification Search
CPC ..... E21B 47/187
(Continued)

(56) References Cited

U.S. PATENT DOCUMENTS 4,562,559 A 12/1985 Sharp et al.
4,578,675 A 3/1986 Macleod
(Continued)

FOREIGN PATENT DOCUMENTS

CA 2899718 8/2014
CA 2893150 5/2015
WO 2014094150 A1 6/2014

OTHER PUBLICATIONS

International Search Report and Written Opinion dated Feb. 24, 2016 for related PCT application No. PCT/CA2015/051313.
(Continued)

*Primary Examiner* — Qutbuddin Ghulamali
(74) *Attorney, Agent, or Firm* — D'Ambrosio & Menon, PLLC; Usha Menon

(57) ABSTRACT

A method for selecting a drilling fluid pressure pulse transmission frequency in a downhole telemetry tool comprises: emitting a frequency sweep wave in a drilling fluid that comprises pressure pulses over a range of frequencies and over a period of time; measuring a pressure of the drilling fluid at the telemetry tool while the frequency sweep wave is being emitted; determining a signal strength at each frequency in the range of frequencies from the measured pressure of the drilling fluid; and selecting at least one frequency in the range of frequencies that meets a selected signal strength threshold as a telemetry signal transmission frequency for the telemetry tool. The method can further comprise encoding the at least one selected frequency in a header message and transmitting the header message to surface using pressure pulse telemetry, and then encoding telemetry data into a pressure pulse telemetry signal and
(Continued)

transmitting the pressure pulse telemetry signal to surface at the at least one selected frequency.

20 Claims, 9 Drawing Sheets

(58) Field of Classification Search
USPC ..... 367/83
See application file for complete search history.

(56) References Cited

U.S. PATENT DOCUMENTS

| | | | | |
|---|---|---|---|---|
| 5,124,953 | A | 6/1992 | Grosso | |
| 5,375,098 | A | 12/1994 | Malone et al. | |
| 6,023,658 | A | 2/2000 | Jeffryes | |
| 6,714,138 | B1 | 3/2004 | Turner et al. | |
| 6,750,783 | B2 | 6/2004 | Rodney | |
| 6,837,332 | B1 | 1/2005 | Rodney | |
| 7,345,594 | B2 * | 3/2008 | Huang | E21B 47/18 340/854.3 |
| 7,453,372 | B2 | 11/2008 | Hentati et al. | |
| 7,940,192 | B2 | 5/2011 | Reckmann et al. | |
| 8,657,035 | B2 | 2/2014 | Latrille et al. | |
| 8,860,582 | B2 | 10/2014 | Clark | |
| 2006/0114747 | A1 * | 6/2006 | Hentati | E21B 47/18 367/83 |
| 2008/0180273 | A1 | 7/2008 | Kyle et al. | |
| 2015/0330217 | A1 * | 11/2015 | Liu | H04B 11/00 367/83 |

OTHER PUBLICATIONS

CIPO Office Action dated Mar. 14, 2018 for co-pending Canadian patent app. No. 2968267.

* cited by examiner

DOWNHOLE TELEMETRY TOOL WITH ADAPTIVE FREQUENCY TRANSMITTER

FIELD

This disclosure relates generally to downhole oil or gas operations, and particularly to a downhole telemetry tool comprising an adaptive frequency transmitter.

BACKGROUND

The recovery of hydrocarbons from subterranean zones relies on the process of drilling wellbores. The process includes drilling equipment situated at surface, and a drill string extending from the surface equipment to a below-surface formation or subterranean zone of interest. The terminal end of the drill string includes a drill bit for drilling (or extending) the wellbore. The process also involves a drilling fluid system, which in most cases uses a drilling fluid ("mud") that is pumped through the inside of piping of the drill string to cool and lubricate the drill bit. The mud exits the drill string via the drill bit and returns to surface carrying rock cuttings produced by the drilling operation. The mud also helps control bottom hole pressure and prevent hydrocarbon influx from the formation into the wellbore, which can potentially cause a blow out at surface.

Directional drilling is the process of steering a well from vertical to intersect a target endpoint or follow a prescribed path. At the terminal end of the drill string is a bottom-hole-assembly ("BHA") which comprises 1) the drill bit; 2) a steerable downhole mud motor of a rotary steerable system; 3) sensors of survey equipment used in logging-while-drilling ("LWD") and/or measurement-while-drilling ("MWD") to evaluate downhole conditions as drilling progresses; 4) means for telemetering data to surface ("telemetry tool"); and 5) other control equipment such as stabilizers or heavy weight drill collars. The BHA is conveyed into the wellbore by a string of metallic tubulars (i.e. drill pipe). MWD equipment is used to provide downhole sensor and status information to surface while drilling in a near real-time mode. This information is used by a rig crew to make decisions about controlling and steering the well to optimize the drilling speed and trajectory based on numerous factors, including lease boundaries, existing wells, formation properties, and hydrocarbon size and location. The rig crew can make intentional deviations from the planned wellbore path as necessary based on the information gathered from the downhole sensors during the drilling process and transmitted to surface by the telemetry tool. The ability to obtain real-time MWD data allows for a relatively more economical and more efficient drilling operation.

One type of downhole telemetry known as mud pulse telemetry involves creating pressure waves ("pulses") in the mud circulating through the drill string. Mud is circulated from surface to downhole using positive displacement pumps. The pressure pulses are created by a fluid pressure pulse generator in the downhole telemetry tool, which controllably changes the flow area and/or path of the mud as it passes through the pulse generator in a timed, coded sequence, thereby creating pressure differentials in the mud. A number of encoding schemes can be used to encode data into mud pulses. These schemes include amplitude phase shift keying (ASK), frequency shift keying (FSK), phase shift keying (PSK), or a combination of these techniques. The choice of modulation scheme uses a finite number of distinct signals to represent digital data, known as symbol sets. PSK uses a finite number of phases, each assigned a unique pattern of binary digits. Usually, each phase encodes an equal number of bits. Each pattern of bits forms the symbol that is represented by the particular phase.

The pulses travel to surface and are received and decoded by a surface receiver which reconstructs the data sent by the telemetry tool. The surface receiver comprises a demodulator which is designed specifically for the symbol-set used by the modulator, determines the phase of the received signal and maps it back to the symbol it represents, thus recovering the original data. Undesired background noise in the mud medium between the telemetry tool and the surface receiver can be caused by a number of sources, including a mud pump, surface rig, other telemetry signals, and the surrounding reservoir formation. This undesired background noise can interfere with the reception of the telemetry signal; conventional approaches to dealing with undesired noise include applying one or more signal processing techniques at surface to separate the undesired noise from the subject telemetry signal. However, successfully decoding a pressure pulse telemetry signal transmitted in a particularly noisy environment can be quite challenging using conventional approaches, and a new solution is desired to meet these challenges.

SUMMARY

According to one aspect of the invention, there is provided a method for selecting a drilling fluid pressure pulse transmission frequency in a downhole telemetry tool. The method comprises: emitting a frequency sweep wave in a drilling fluid that comprises pressure pulses over a range of frequencies and over a period of time; measuring a pressure of the drilling fluid at the telemetry tool while the frequency sweep wave is being emitted; determining a signal strength at each frequency in the range of frequencies from the measured pressure of the drilling fluid; and selecting at least one frequency in the range of frequencies that meets a selected signal strength threshold as a telemetry signal transmission frequency for the telemetry tool. The method can further comprise encoding the at least one selected frequency in a header message and transmitting the header message to surface using pressure pulse telemetry, and then encoding telemetry data into a pressure pulse telemetry signal and transmitting the pressure pulse telemetry signal to surface at the at least one selected frequency.

The method can also comprise receiving measurement-while-drilling (MWD) sensor data and determining drilling conditions from the MWD sensor data, then selecting a time period to emit the frequency sweep wave based at least in part on the determined drilling conditions.

The frequency sweep wave can be emitted during a drill string idle time or when the drilling fluid is flowing but the telemetry tool is not transmitting any telemetry signals. The frequency sweep wave can comprise a range of frequencies between 1 Hz and a maximum operating frequency of the telemetry tool.

The step of determining the signal strength at each frequency in the range of frequencies can comprise applying a time-frequency analysis to the measured pressure of the drilling fluid. The time-frequency analysis can be selected from a group consisting of: Fourier transforms, wavelet analysis, and fast orthogonal search. Alternatively, the step of determining the signal strength at each frequency in the range of frequencies can comprise determining a noise component at each frequency in the range of frequencies and selecting at least one frequency having a signal-to-noise ratio that meets a minimum signal-to-noise ratio threshold.

According to another aspect of the invention, there is provided a downhole telemetry tool for transmitting a pressure pulse telemetry signal in a drilling fluid. The telemetry tool comprises: a pressure pulse generator operable to generate pressure pulses in a drilling fluid over a range of frequencies; a pressure transducer operable to measure a pressure of the drilling fluid at the telemetry tool; and a controller communicative with the pressure pulse generator and the pressure transducer. The controller comprises a processor and a memory having stored thereon program code executable by the processor to perform a transmission frequency selection operation comprising: (i) instructing the pressure pulse generator to emit a frequency sweep wave in the drilling fluid that comprises pressure pulses over a range of frequencies and over a period of time; (ii) reading pressure measurements from the pressure transducer while the frequency sweep wave is being emitted; and (iii) determining a signal strength at each frequency in the range of frequencies from the measured pressure of the drilling fluid, and selecting at least one frequency in the range of frequencies that meets a selected signal strength threshold as a telemetry signal transmission frequency for the telemetry tool.

The memory can further comprise program code executable by the processor to encode the at least one selected frequency in a header message and transmit the header message to surface using the pressure pulse generator. The memory can further comprise program code executable by the processor to encode telemetry data into a pressure pulse telemetry signal and transmit the pressure pulse telemetry signal to surface at the at least one selected frequency using the pressure pulse generator.

The pulse generator can comprise a rotor and stator valve mechanism, as well as a pulser assembly having a flexible pressure compensation device in fluid communication on one side with the drilling fluid and on an opposite side with lubricating fluid inside the pulser assembly. The pressure transducer is inside the pulser assembly and configured to measure the drilling fluid pressure by measuring a pressure of the lubricating fluid.

The downhole telemetry tool can further comprise at least one measurement-while-drilling (MWD) sensor communicative with the controller such that the controller can determine drilling conditions from data read from the at least one MWD sensor. In this case, the memory further comprises program code executable by the processor to select a time period to emit the frequency sweep wave based at least in part on the determined drilling conditions.

DETAILED DESCRIPTION OF EMBODIMENTS

Directional terms such as "uphole" and "downhole" are used in the following description for the purpose of providing relative reference only, and are not intended to suggest any limitations on how any apparatus is to be positioned during use, or to be mounted in an assembly or relative to an environment.

Overview

The embodiments described herein generally relate to a downhole telemetry tool having a fluid pressure pulse generator comprising a rotor and stator valve mechanism, a pressure transducer, and a controller programmed to perform a transmission frequency selection operation to automatically select one or more frequencies for transmitting a pressure pulse telemetry signal from the telemetry tool to surface. The fluid pressure pulse generator may be used for mud pulse ("MP") telemetry used in downhole drilling, wherein a drilling fluid ("mud") is used to transmit telemetry pulses to surface. A motor rotates the rotor relative to the stator between a fully opened position where there is no restriction of mud flowing through the fluid pressure pulse generator (and thus no pulse is generated), and a maximum restricted flow position where there is a maximum restriction of mud flowing through the fluid pressure pulse generator (and thus a pressure pulse of maximum amplitude is generated). The pressure transducer measures the pressure of the drilling fluid at the fluid pressure pulse generator. The controller is communicative with the pressure transducer and motor, and comprises a processor and a memory having encoded thereon a transmission frequency selection program that is executable by the processor to cause the pulse generator to generate a frequency sweep wave comprising a defined pulse pattern across a range of frequencies, to read pressure measurements taken by the pressure transducer during emission of the frequency sweep wave, and to determine whether any frequency in the frequency sweep wave is sufficiently free of undesired background noise for a telemetry signal transmitted by the telemetry tool to be received and decoded at surface.

Downhole Telemetry Tool

Figure 1:
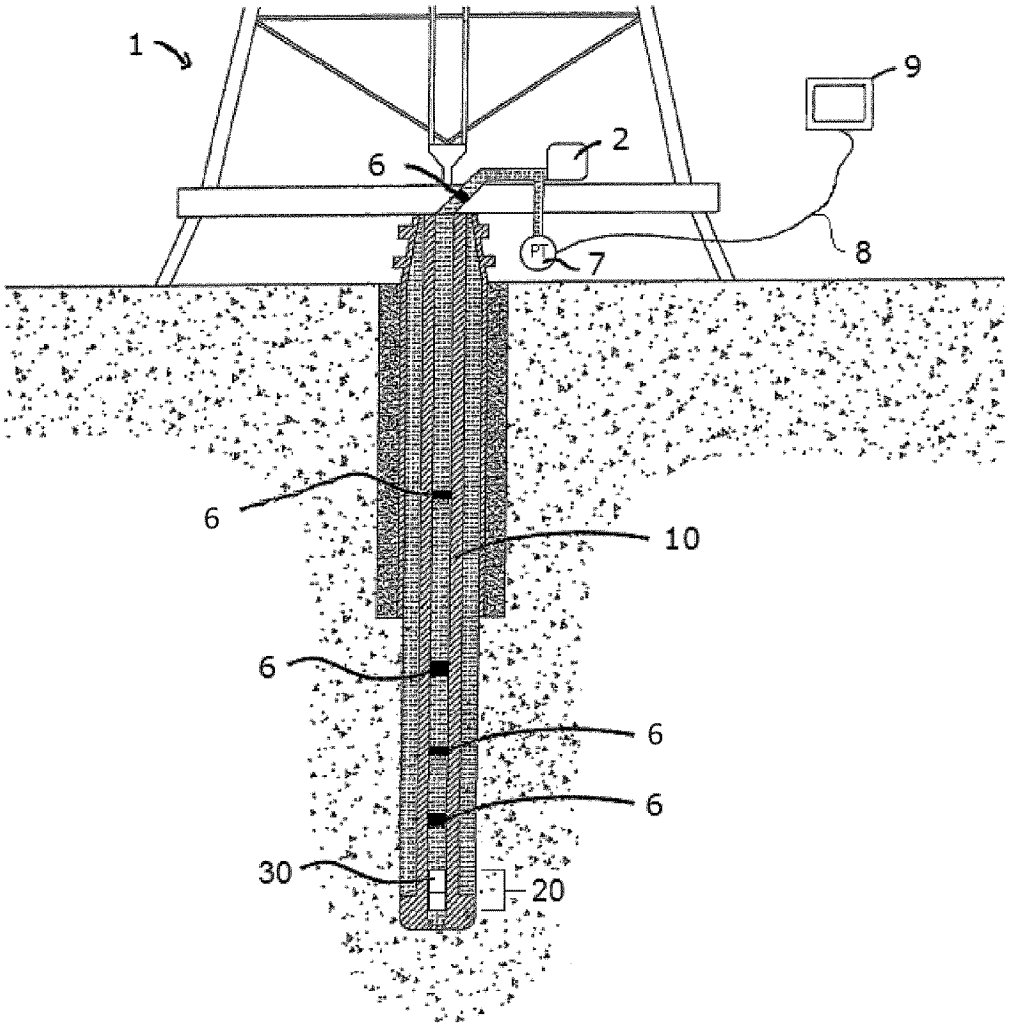
FIG. 1 is a schematic of a drill string in an oil and gas borehole comprising a downhole telemetry tool in accordance with embodiments of the invention.
Figure 5:
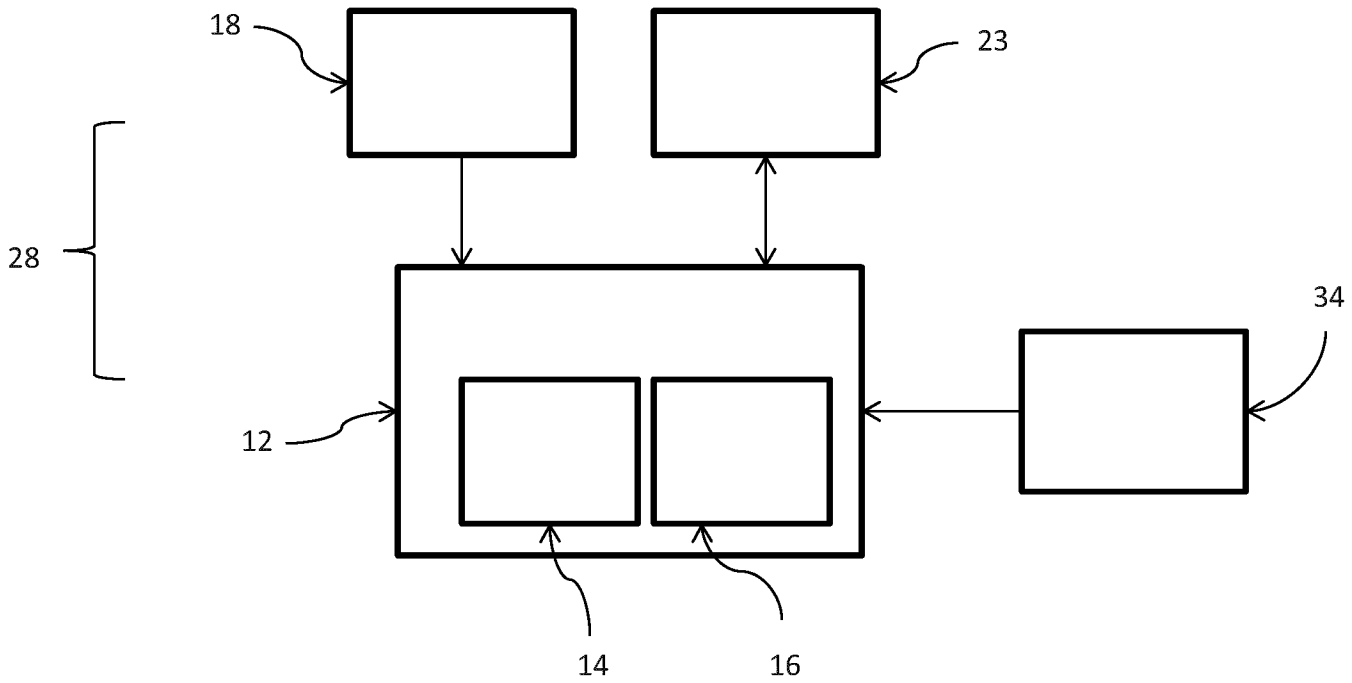
FIG. 5 is a schematic block diagram of components of an electronics subassembly of the telemetry tool.

Referring to FIG. 1, there is shown a schematic representation of a MP telemetry operation using a fluid pressure pulse generator. In downhole drilling equipment 1, drilling mud is pumped down a drill string by pump 2 and passes through a downhole telemetry tool 20. The downhole telemetry tool 20 includes a fluid pressure pulse generator 30. The fluid pressure pulse generator 30 has a maximum open position in which mud flows relatively unimpeded through the pressure pulse generator 30 and no pressure pulse is generated and a maximum restricted flow position where flow of mud through the pressure pulse generator 30 is maximally restricted and the peak of a positive pressure pulse is generated (represented schematically as block 6 in mud column 10). Information acquired by downhole sensors (not shown) is encoded by the downhole telemetry tool 20 into a telemetry signal and transmitted as a pattern of pressure pulses 6 in the mud column 10. More specifically, signals from sensor modules in the downhole telemetry tool 20, or in another downhole probe (not shown) communicative with the downhole telemetry tool 20, are received and processed in a data encoder in the downhole telemetry tool 20 where the data is digitally encoded as is well established in the art. This data is sent to a controller 12 (as shown in FIG. 5) in the downhole telemetry tool 20 which then actuates the fluid pressure pulse generator 30 to generate pressure pulses 6 which contain the encoded data. The pressure pulses 6 are transmitted to the surface and detected by a surface pressure transducer 7 and decoded by a surface computer 9 communicative with the transducer by cable 8. The decoded signal can then be displayed by the computer 9 to a drilling operator. The characteristics of the pressure pulses 6 are defined by duration, shape, and frequency, and these characteristics are used in various encoding systems to represent binary data. As will be discussed in greater detail below, the pressure pulses are sent at one or more frequencies which have been determined to have sufficiently low amount of undesired noise that the telemetry signal can be received and decoded at surface.

Figure 2A:
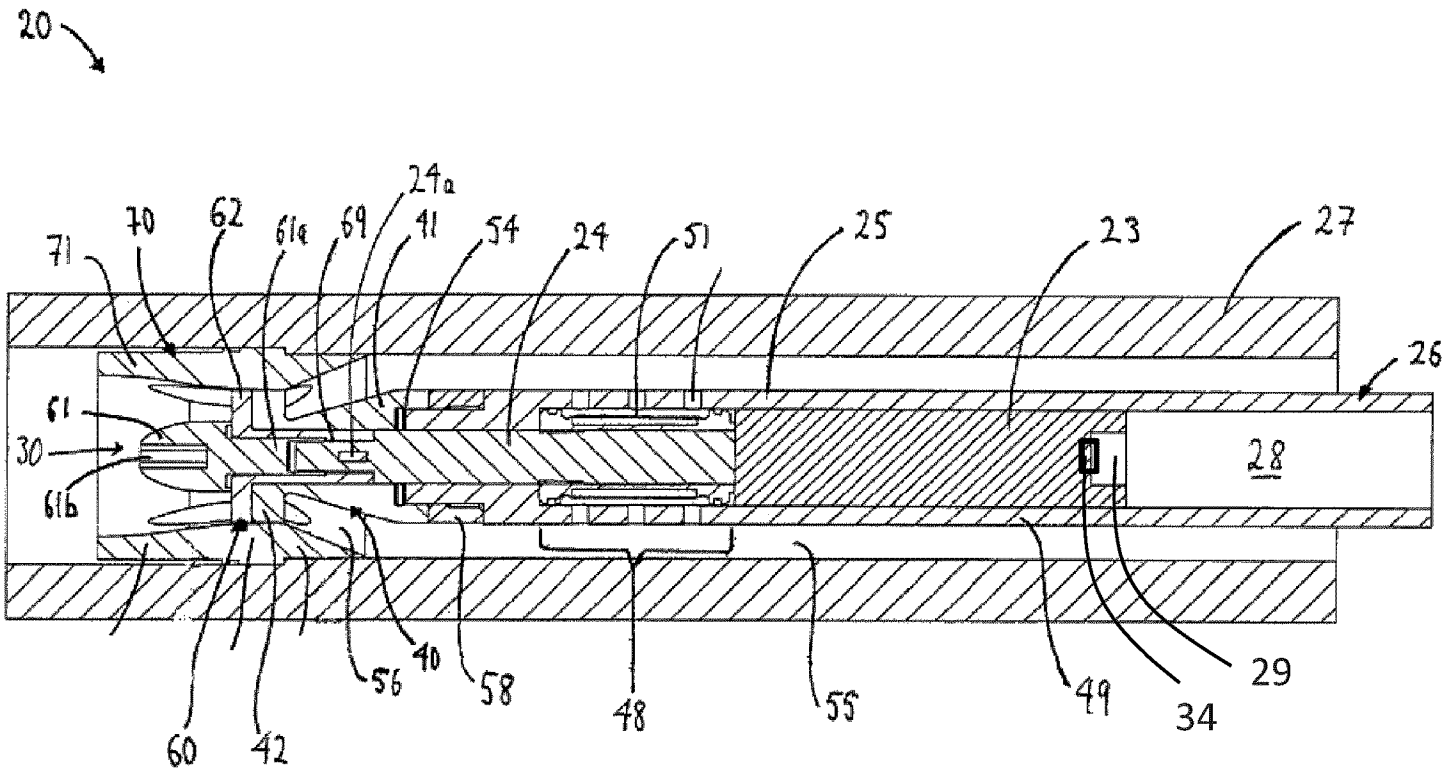
FIG. 2(*a*) is a longitudinally sectioned view of a mud pulser section of the downhole telemetry tool.

Referring to FIG. 2(*a*), the downhole telemetry tool 20 is shown in more detail. The downhole telemetry tool 20 generally comprises the fluid pressure pulse generator 30 which creates fluid pressure pulses, and a pulser assembly 26 which drives the fluid pressure pulse generator 30 and which optionally can take measurements while drilling. The fluid pressure pulse generator 30 and pulser assembly 26 are axially located inside a drill collar 27. A flow bypass sleeve 70 received inside the drill collar 27 surrounds the fluid pressure pulse generator 30. The pulser assembly 26 is fixed to the drill collar 27 with an annular channel 55 therebetween, and mud flows along the annular channel 55 when the downhole telemetry tool 20 is downhole. The pulser assembly 26 comprises a pulser assembly housing 49 enclosing a motor subassembly 25 and an electronics subassembly 28 electronically coupled together but fluidly separated by a feed-through connector 29. The motor subassembly 25 includes a motor and gearbox subassembly 23, a driveshaft 24 connected to the motor and gearbox subassembly 23, and a pressure compensation device 48. The fluid pressure pulse generator 30 comprises a stator 40 and a rotor 60 located inside the flow bypass sleeve 70. The stator 40 is fixed to the pulser assembly housing 49 and the rotor 60 is fixed to the driveshaft 24. Rotation of the driveshaft 24 by the motor and gearbox subassembly 23 rotates the rotor 60 relative to the fixed stator 40.

The fluid pressure pulse generator 30 is located at the downhole end of the downhole telemetry tool 20. Mud pumped from the surface by pump 2 flows along annular channel 55 between the outer surface of the pulser assembly 26 and the inner surface of the drill collar 27. When the mud reaches the fluid pressure pulse generator 30 it flows along an annular channel 56 provided between the external surface of the stator 40 and the internal surface of the flow bypass sleeve 70. The rotor 60 can rotate between an open position where mud flows freely through the fluid pressure pulse generator 30 resulting in no pressure pulse and a restricted flow position where flow of mud is restricted to generate pressure pulse 6.

The motor subassembly 25 is filled with a lubricating liquid such as hydraulic oil or silicon oil and this lubricating liquid is fluidly separated from mud flowing along the annular channel 55 by an annular seal 54 which surrounds the driveshaft 24. The pressure compensation device 48 comprises a flexible membrane 51 in fluid communication with the lubrication liquid on one side and with mud on the other side via ports 50 in the pulser assembly housing 49; this allows the pressure compensation device 48 to maintain the pressure of the lubrication liquid at about the same pressure as the mud at the fluid pressure pulse generator 30.

A pressure transducer 34 is mounted in the feed through connector 29 such that the pressure transducer 34 can measure the pressure of the lubrication liquid. Because the pressure of the lubrication liquid corresponds to the pressure of the drilling mud at the pulse generator 30, the pressure transducer 34 can be used to measure the pressure pulses 6 generated by the pulse generator 30.

The electronics subassembly 28 includes the controller 12, as well as downhole sensors and other components required by the downhole telemetry tool 20 to determine direction and inclination information and to take measurements of drilling conditions, to encode this telemetry data using one or more known modulation techniques into a carrier wave, and to send motor control signals to the motor and gearbox subassembly 23 to rotate the driveshaft 24 and rotor 60 in a controlled pattern to generate pressure pulses 6 representing the carrier wave for transmission to surface. Also, as will be described in more detail below in reference to FIG. 5, the controller 12 comprises a processor 14 and a memory 16 having stored thereon a transmission frequency selection program that when executed by the processor will determine from the pressure measurements of the frequency sweep which frequencies have a sufficiently low amount of noise that a telemetry signal can be received and decoded at surface, then select a suitable frequency for transmitting the telemetry signal to surface.

Figure 3B:
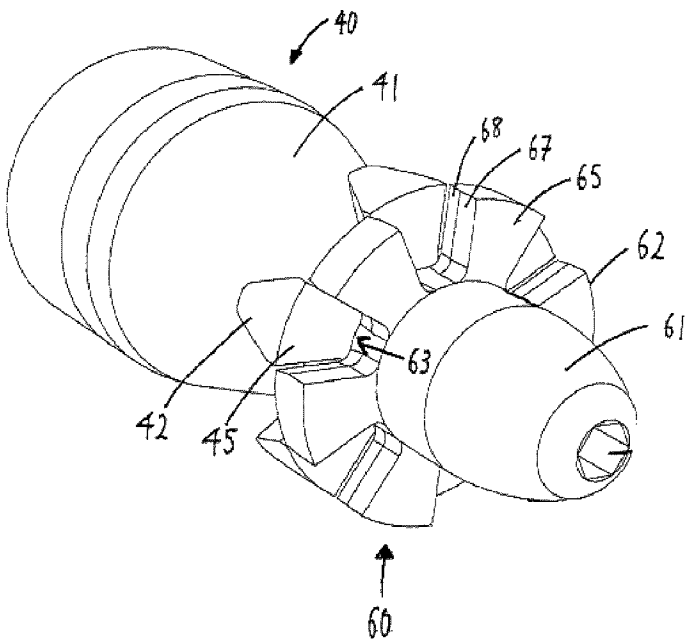
FIGS. 3(*a*) and (*b*) are rear and front perspective views of a fluid pressure pulse generator of the downhole telemetry tool, wherein a rotor of the fluid pressure pulse generator is shown in a maximum restricted flow position.
Figure 3A:
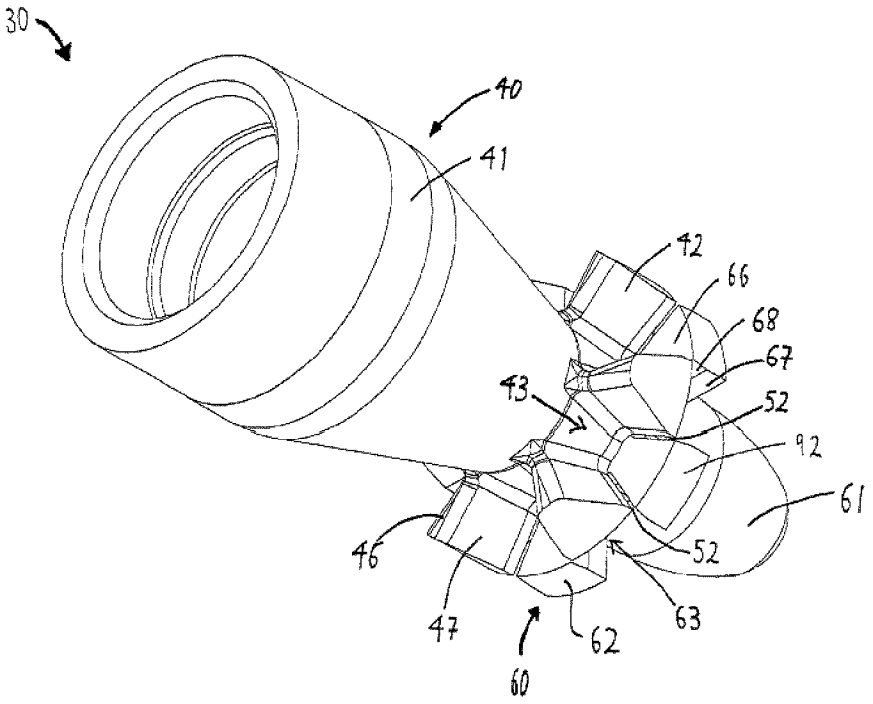
Figure 4:
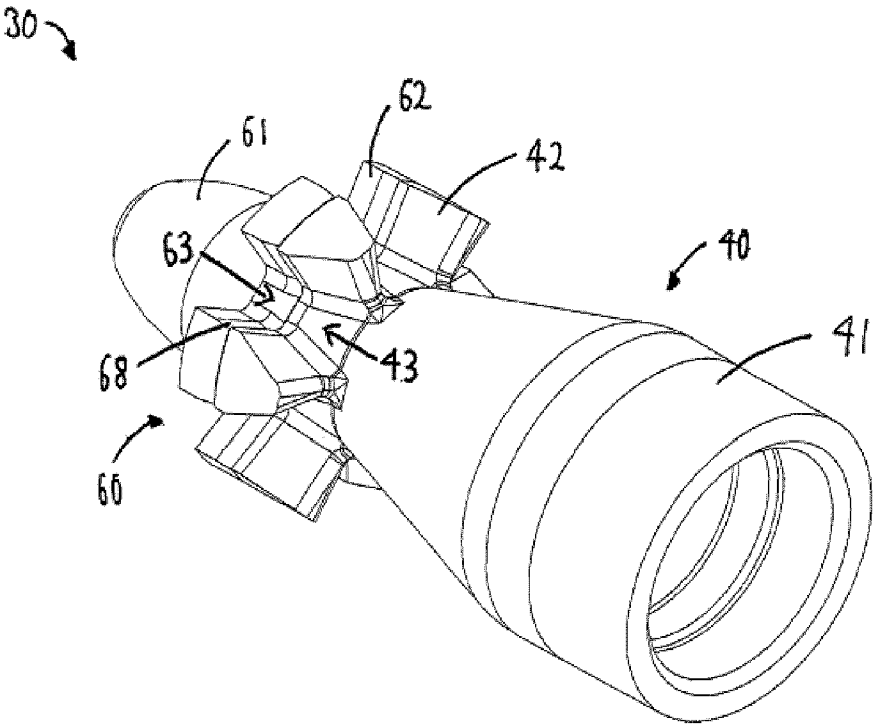
FIG. 4 is a rear perspective view of the fluid pressure pulse generator, wherein the rotor is shown in a fully opened flow position.

The fluid pressure pulse generator 30 can comprise a rotor/stator combination of different designs. One particular embodiment of a rotor/stator combination is shown in FIGS. 3 to 4 ("single pulse amplitude rotary vane pulser") and can generate pulses of the same pulse amplitude. Another embodiment of a rotor/stator combination (not shown) ("dual pulse amplitude rotary vane pulser") can generate pulses of two different pulse amplitude. Other suitable rotor/stator combinations would be apparent to one skilled in the art, and include a rotor/stator combination as disclosed in PCT applications no. PCT/CA2013/050843 and PCT/CA2013/050966.

Fluid Pressure Pulse Generator

Referring now to FIGS. 3-4 and according to one embodiment of the fluid pressure pulse generator 30, the stator 40 comprises a longitudinally extending stator body 41 with a central bore therethrough. The stator body 41 comprises a cylindrical section at the uphole end and a generally frustoconical section at the downhole end which tapers longitudinally in the downhole direction. As shown in FIG. 2(*a*), the cylindrical section of stator body 41 is coupled with the pulser assembly housing 49. More specifically, a jam ring 58 threaded onto the pulser assembly housing 49 is threaded on the stator body 41. Once the stator 40 is positioned correctly, the stator 40 is held in place and the jam ring 58 is backed off and torqued onto the stator 40 holding it in place. The stator 40 surrounds annular seal 54. The external surface of the pulser assembly housing 49 is flush with the external surface of the cylindrical section of the stator body 41 for smooth flow of mud therealong.

A plurality of radially extending projections 42 are spaced equidistant around the downhole end of the stator body 41. Each stator projection 42 is tapered and narrower at its proximal end attached to the stator body 41 than at its distal end. The stator projections 42 have a radial profile with an uphole end or face 46 and a downhole end or face 45, with two opposed side faces 47 extending therebetween. A section of the radial profile of each stator projection 42 is tapered towards the uphole end or face 46 such that the uphole end or face 46 is narrower than the downhole end or face 45. The stator projections 42 have a rounded uphole end 46 and most of the stator projection 42 tapers towards the rounded uphole end 46.

Mud flowing along the external surface of the stator body 41 contacts the uphole end or face 46 of the stator projections 42 and flows through stator flow channels 43 defined by the side faces 47 of adjacently positioned stator projections 42. The stator flow channels 43 are curved or rounded at their proximal end closest to the stator body 41. The stator projections 42 and thus the stator flow channels 43 defined therebetween may be any shape and dimensioned to direct flow of mud through the stator flow channels 43.

The rotor 60 comprises a generally cylindrical rotor body 69 with a central bore therethrough and a plurality of radially extending projections 62. As shown in FIG. 2(*a*), the rotor body 69 is received in the bore of the stator body 41. A downhole shaft of the driveshaft 24 is received in uphole end of the bore of the rotor body 69 and a coupling key 24*a* extends through the driveshaft 24 and is received in a coupling key receptacle (not shown) at the uphole end of the rotor body 69 to couple the driveshaft 24 with the rotor body 69. A rotor cap comprising a cap body 61 and a cap shaft 61*a* is positioned at the downhole end of the fluid pressure pulse generator 30. The cap shaft 61*a* extends through the downhole end of the bore of the rotor body 69 and threads onto the downhole shaft of the driveshaft 24 to lock (torque) the rotor 60 to the driveshaft 24.

The radially extending rotor projections 62 are spaced equidistant around the downhole end of the rotor body 69 and are axially positioned downhole relative to the stator projections 42. The rotor projections 62 rotate in and out of fluid communication with the stator flow channels 43 to generate pressure pulse 6 as is described in more detail below. Each rotor projection 62 has a radial profile including an uphole end or face and a downhole end or face 65, with two opposed side faces 67 and an end face 92 extending between the uphole end or face and the downhole end or face 65. The rotor projections 62 taper from the end face 92 towards the rotor body 69 so that the rotor projections 62 are narrower at the point that joins the rotor body 69 than at the end face 92. Each side face 67 has a bevelled or chamfered uphole edge 68 which is angled inwards towards the uphole face such that an uphole section of the radial profile of each of the rotor projections 62 tapers in an uphole direction towards the uphole face.

In order to generate fluid pressure pulses 6 a controller (not shown) in the electronics subassembly 28 sends motor control signals to the motor and gearbox subassembly 23 to rotate the driveshaft 24 and rotor 60 in a controlled pattern.

Electronics Subassembly

Referring now to FIG. 5, the electronics subassembly 28 includes the controller 12 and MWD sensors 18 for taking various downhole measurements, such as a directional and inclination (D&I) sensor module and a drilling conditions sensor module. The controller 12 can read measurements taken by the sensors 18 and the pressure transducer 34 and is communicative with the motor and gearbox subassembly 23 to read motor status data therefrom and to send motor control signals thereto. As noted previously, the controller 12 comprises the processor 14 and the memory 16 which has encoded thereon the transmission frequency selection program executable by the processor 14. In this embodiment, the memory 16 also has stored thereon a modulation program executable by the processor 14 to encode the measurements and other information (collectively "telemetry data") into a telemetry signal, and a motor control program executable by the processor 14 to operate the motor and gearbox subassembly 23 of the pulse generator 30 to generate pressure pulses representing the telemetry signal. The memory 16 comprises non-transitory memory units such as read-only memory (ROM) and random access memory (RAM) and the programs can be stored on one or both of these types of memory units. In an alternative embodiment, separate controllers can be provided for executing the transmission frequency selection program and for encoding measurements and other information and controlling the operation of the motor and gearbox subassembly 23. In yet another embodiment, the electronics subassembly 28 is provided with one controller for executing the transmission frequency selection program, a separate encoder for encoding measurement data into a telemetry signal, and another controller for operating the motor and gearbox subassembly 23 to generate pressure pulses representing the telemetry signal.

The modulation program utilizes a modulation technique that uses principles of known digital modulation techniques. In this embodiment, the encoder program code utilizes a modulation technique known as asymmetric phase shift keying (APSK) that is a combination of amplitude shift keying and phase shift keying to encode the telemetry data into a dual pulse height telemetry signal. Alternatively, another modulation technique can be used that includes amplitude shift keying only, or amplitude shift keying along with another type of modulation such as frequency shift keying.

Referring now to FIGS. 6 to 9, the transmission frequency selection program can be automatically executed by the processor 14 to perform a transmission frequency selection operation that comprises a series of steps to determine suitable mud pulse frequencies to transmit the telemetry signal, and to operate the pulse generator 30 to transmit the telemetry signal at one or more of these frequencies. Suitable frequencies mean any frequency which has a sufficiently low amount of undesired noise that the telemetry signal can be successfully received and decoded at surface.

The pulse generator 30 can be operated to transmit pulses at different frequencies by operating the rotor at different speeds. As the amount of undesired noise can vary between frequencies, the telemetry tool 20 can take advantage of its ability to transmit at different frequencies and its ability to measure the pressure profile of the mud medium at the telemetry tool 20 in order to select the best frequencies to transmit a telemetry signal, i.e. the frequencies with the least amount of undesired noise.

Figure 9:
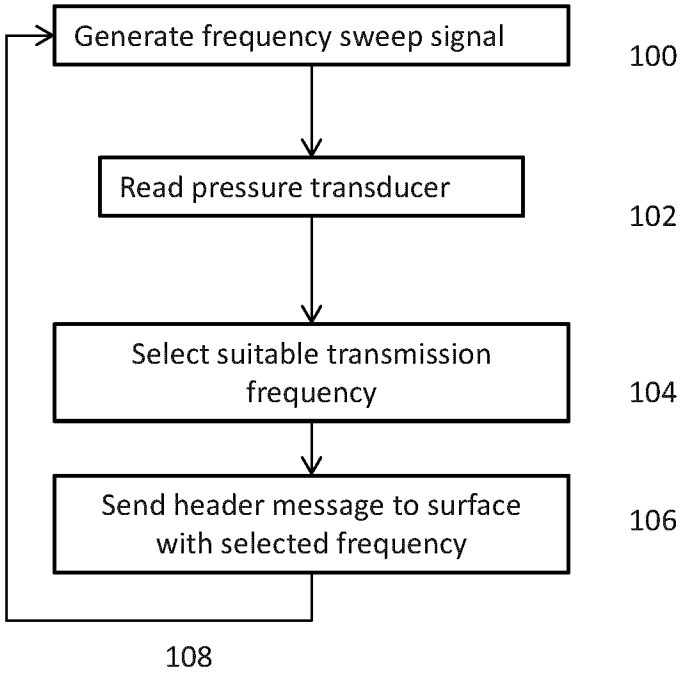
FIG. 9 is a flowchart of steps performed by the processor when executing the transmission frequency selection program.

Referring to FIG. 9, the transmission frequency selection program comprises a series of steps that when executed by the processor 14, determine the amount of noise at different frequency increments, and selects the best transmission frequencies.

Figure 6:
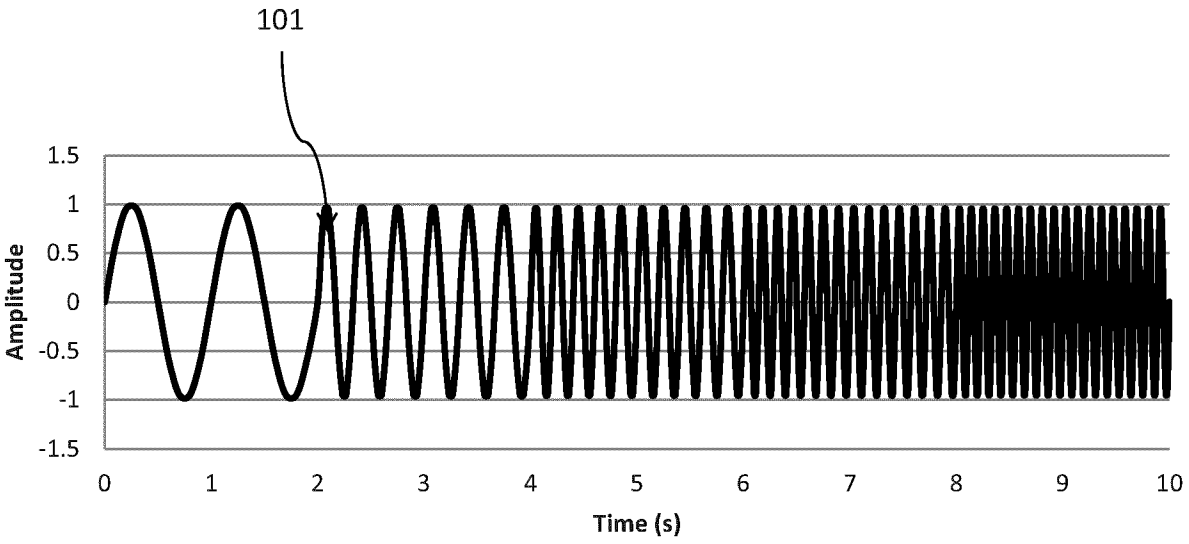
FIG. 6 is an amplitude-time graph of a frequency sweep wave emitted by the telemetry tool during execution of a transmission frequency selection program by a processor of the electronics subassembly.

In step 100, the transmission frequency selection program sends a control signal to the motor and gearbox subassembly to operate the pulse generator 30 to generate a frequency sweep wave 101 (as shown in FIG. 6). The frequency sweep wave can be transmitted at certain defined time intervals or between blocks of data during a telemetry signal transmission. In particular, the frequency sweep wave 101 can be transmitted during an drill string idle time, or while mud is flowing but the telemetry tool 20 is not transmitting a telemetry signal. The frequency sweep wave 101 comprises a constant amplitude waveform comprising multiple increasing frequency increments across a defined range of frequencies; in the exemplary frequency sweep wave 101 shown in FIG. 6, the frequency range is between 1 Hz and 9 Hz and consists of five different frequency increments across a period of 10 seconds, namely: 1 Hz from 0 to 2 seconds, 3 Hz from 2 to 4 seconds, 5 Hz from 4 to 6 seconds, 7 Hz from 6 to 8 seconds and 9 Hz from 8 to 10 seconds. In alternative embodiments, the frequency range, number of frequency increments, and the period can vary.

Figure 7:
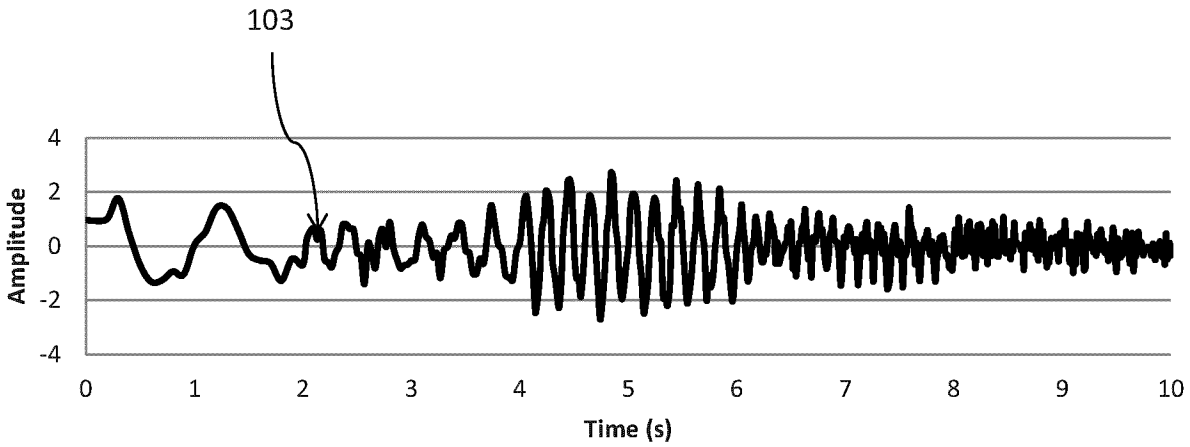
FIG. 7 is an amplitude-time graph of drilling fluid pressure measured by the pressure transducer during emission of the frequency sweep wave.

In step 102, the transmission frequency selection program reads the pressure transducer 34 during the period the frequency sweep wave 101 is being transmitted. An exemplary pressure reading 103 from the pressure transducer 34 is shown in FIG. 7; this graph shows that the frequency sweep wave 101 is interfered by background noise.

Figure 8:
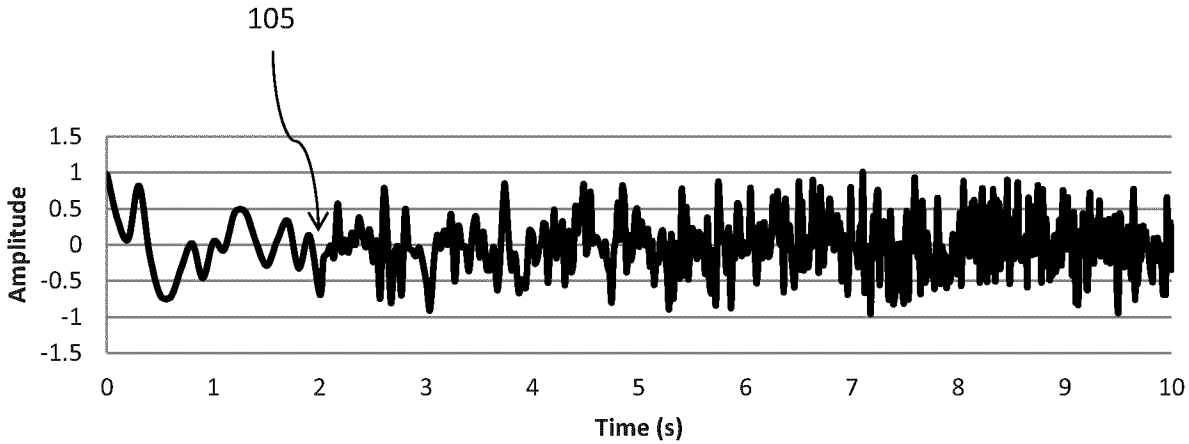
FIG. 8 is an amplitude-time graph of the background noise isolated from the pressure measurements taken by the pressure transducer during emission of the frequency sweep wave.

In step 104, the transmission frequency selection program analyzes the pressure reading 103 to determine a suitable transmission frequency. Multiple methods can be used to make this determination. In one embodiment, the pressure reading 103 is subtracted from the frequency sweep wave 101 to obtain a noise pattern 105 as shown in FIG. 8. The noise at each frequency increment can be determined from this noise pattern 105, and analysed to determine which frequency increment has the least amount of interference. The analyzing comprises selecting a minimum signal-to-noise ratio that should allow the surface receiver to receive and demodulate the telemetry signal (e.g. 20 db). This minimum signal-to-noise ratio may vary depending on a number of factors, including the depth of the downhole tool. An actual signal-to-noise ratio is determined at each frequency increment by dividing the frequency sweep wave 101 by the isolated noise pattern 105. Each frequency having an actual signal-to-noise ratio that is higher than the minimum signal-to-noise ratio is suitable for use by the telemetry tool 20 to transmit the telemetry signal. If there is more than one frequency having a signal-to-noise ratio that is higher than the minimum signal-to-noise ratio, then the transmission frequency selection program selects the frequency or frequencies having the highest signal-to-noise ratio for transmission. In another embodiment, a time-frequency analysis is applied to the length of the frequency sweep wave 101 to determine the strength of the transmitting frequency. Such analysis may include Fourier transforms (and their derivatives such as Fast Fourier Transform and short-time Fourier Transform), wavelet analysis, and Fast Orthogonal Search (FOS). The strength of the transmitting frequency is compared among all frequencies in the frequency sweep wave 101 and the strongest frequency which also meets the minimum signal-to-noise ratio is selected as the transmission frequency. In the exemplary noise pattern 105 shown in FIG. 8, the frequency increment of 4 to 6 seconds has the highest signal-to-noise ratio, and the corresponding frequency of 5 Hz is selected for telemetry transmission.

Once the frequency or frequencies have been selected, the transmission frequency selection program at step 106 prepares a header message that includes the selected transmission frequency or frequencies, and instructs the controller 12 to encode this header message, and cause the pulse generator 30 to transmit a telemetry signal to surface containing this header message. This telemetry signal can be sent at the last transmitting frequency on the assumption that the surface receiver is configured to receive telemetry signals at this frequency, or at some other defined frequency which the surface frequency is configured to receive. Once the surface receiver receives this telemetry signal and decodes the header message, it will update its configuration to receive telemetry signals at the new frequency or frequencies. Optionally, the surface receiver can instruct a surface transmitter to transmit an acknowledgement message to the telemetry tool 20 which acknowledges that the frequency configuration has been updated.

In step 108, the transmission frequency selection program returns to step 100 to repeat the process of selecting a suitable transmission frequency, either immediately or after a certain period of time has elapsed. Optionally, the transmission frequency selection program can determine a suitable time to perform a transmission frequency selection operation based on the drilling conditions; the drilling conditions can be determined from measurements taken by the MWD sensors 18 and compared to defined criteria. For example, the MWD sensors 18 can determine when the mud density has changed; as mud density tends to affect the choice of telemetry signal frequency, the transmission frequency selection program can be executed whenever the mud density has changed beyond a defined threshold.

As the pressure transducer 34 is located upstream of the pulse generator 30, signal propagation from the pressure transducer 34 to surface behaves similarly to pressure wave propagations in an open pipe. Pressure wave reflections that travel from the pulse generator 30, down to the drill bit, and back up the pulse generator 30 can be captured with the pressure transducer 34 and accounted for when isolating the noise from the frequency sweep wave.

As the telemetry tool 20 can automatically select a suitable transmission frequency, an operator at surface does not need to manually select which transmitting frequency to use for each run/job. In addition to reducing the burden on the operator, the automatic transmission frequency selection by the telemetry tool 20 may also improve the telemetry transmission performance, as the telemetry tool 20 has the potential to react quickly to changing conditions. Further, the telemetry tool 20 that can automatically select the transmission frequency can potentially reduce the time required for an operator to set up the telemetry tool.

While particular embodiments have been described in this description, it is to be understood that other embodiments are possible and that the invention is not limited to the described embodiments and instead are defined by the claims.

What is claimed is:

1. A method for selecting a drilling fluid pressure pulse transmission frequency in a downhole telemetry tool, comprising:

(a) emitting from the downhole telemetry tool a frequency sweep wave in a drilling fluid, comprising pressure pulses over a range of frequencies and over a period of time;

(b) measuring a pressure of the drilling fluid at the downhole telemetry tool while the frequency sweep wave is being emitted;

(c) determining a signal strength at each frequency in the range of frequencies from the measured pressure of the drilling fluid, wherein the pressure of the drilling fluid is measured at the downhole telemetry tool, and wherein the frequency sweep wave in the drilling fluid is emitted from the downhole telemetry tool; and (d) selecting, based on the signal strength determined at each frequency, at least one frequency in the range of frequencies that meets a selected signal strength threshold as a telemetry signal transmission frequency for the downhole telemetry tool.

2. The method as claimed in claim 1 further comprising after (d):

(e) encoding the at least one selected frequency in a header message and transmitting the header message to surface using pressure pulse telemetry.

3. The method as claimed in claim 2 further comprising after (e):

(f) encoding telemetry data into a pressure pulse telemetry signal and transmitting the pressure pulse telemetry signal to the surface at the at least one selected frequency.

4. The method as claimed in claim 3 further comprising receiving measurement-while-drilling (MWD) sensor data and determining drilling conditions from the MWD sensor data, then selecting a time period to emit the frequency sweep wave based at least in part on the determined drilling conditions.

5. The method as claimed in claim 3 further comprising emitting the frequency sweep wave during a drill string idle time or when the drilling fluid is flowing but the telemetry tool is not transmitting any telemetry signals.

6. The method as claimed in claim 1 wherein the frequency sweep wave comprises a range of frequencies between 1 Hz and a maximum operating frequency of the telemetry tool.

7. The method as claimed in claim 1 wherein the step of determining the signal strength at each frequency in the range of frequencies comprises applying a time-frequency analysis to the measured pressure of the drilling fluid.

8. The method as claimed in claim 7 wherein the time-frequency analysis is selected from a group consisting of: Fourier transforms, wavelet analysis, and fast orthogonal search.

9. The method as claimed in claim 1 wherein the step of determining the signal strength at each frequency in the range of frequencies comprises determining a noise component at each frequency in the range of frequencies and selecting at least one frequency having a signal-to-noise ratio that meets a minimum signal-to-noise ratio threshold.

10. A downhole telemetry tool for transmitting a pressure pulse telemetry signal in a drilling fluid, comprising:

(a) a pressure pulse generator operable to generate pressure pulses in a drilling fluid over a range of frequencies;

(b) a pressure transducer operable to measure a pressure of the drilling fluid at the downhole telemetry tool; and (c) a controller communicative with the pressure pulse generator and the pressure transducer, and comprising a processor and a memory having stored thereon program code executable by the processor to perform a transmission frequency selection operation comprising:

(i) instructing the pressure pulse generator to emit a frequency sweep wave in the drilling fluid that comprises pressure pulses over a range of frequencies and over a period of time;

(ii) reading pressure measurements from the pressure transducer while the frequency sweep wave is being emitted; and (iii) determining a signal strength at each frequency in the range of frequencies from the measured pressure of the drilling fluid, wherein the pressure of the drilling fluid is measured by the pressure transducer of the downhole telemetry tool, and wherein the frequency sweep wave in the drilling fluid is emitted by the pressure pulse generator of the downhole telemetry tool; and (iv) selecting, based on the signal strength determined at each frequency, at least one frequency in the range of frequencies that meets a selected signal strength threshold as a telemetry signal transmission frequency for the downhole telemetry tool.

11. The downhole telemetry tool as claimed in claim 10 wherein the pulse generator comprises a rotor and stator valve mechanism.

12. The downhole telemetry tool as claimed in claim 11 further comprising a pulser assembly having a flexible pressure compensation device in fluid communication on one side with the drilling fluid and on an opposite side with lubricating fluid inside the pulser assembly, and wherein the pressure transducer is inside the pulser assembly and configured to measure the drilling fluid pressure by measuring a pressure of the lubricating fluid.

13. The downhole telemetry tool as claimed in claim 10 wherein the memory further comprises program code executable by the processor to: encode the at least one selected frequency in a header message and transmit the header message to surface using the pressure pulse generator.

14. The downhole telemetry tool as claimed in claim 10 wherein the memory further comprises program code executable by the processor to: encode telemetry data into a pressure pulse telemetry signal and transmit the pressure pulse telemetry signal to surface at the at least one selected frequency using the pressure pulse generator.

15. The downhole telemetry tool as claimed in claim 10 further comprising at least one measurement-while-drilling (MWD) sensor communicative with the controller such that the controller can determine drilling conditions from data read from the at least one MWD sensor, and wherein the memory further comprises program code executable by the processor to: select a time period to emit the frequency sweep wave based at least in part on the determined drilling conditions.

16. The downhole telemetry tool as claimed in claim 15 wherein the memory further comprises program code executable by the processor to: emit the frequency sweep wave during a drill string idle time or when the drilling fluid is flowing but the telemetry tool is not transmitting any telemetry signals.

17. The downhole telemetry tool as claimed in claim 10 wherein the frequency sweep wave comprises a range of frequencies between 1 Hz and a maximum operating frequency of the telemetry tool.

18. The downhole telemetry tool in claim 10 wherein the step of determining the signal strength at each frequency in the range of frequencies comprises applying a time-frequency analysis to the measured pressure of the drilling fluid.

19. The downhole telemetry tool as claimed in claim 18 wherein the time-frequency analysis is selected from a group consisting of: Fourier transforms, wavelet analysis, and fast orthogonal search.

20. The downhole telemetry tool as claimed in claim 10 wherein the step of determining the signal strength at each frequency in the range of frequencies comprises determining a noise component at each frequency in the range of frequencies and selecting at least one frequency having a signal-to-noise ratio that meets a minimum signal-to-noise ratio threshold.

* * * * *